US011076252B2

(12) United States Patent
Hosoya et al.

(10) Patent No.: US 11,076,252 B2
(45) Date of Patent: Jul. 27, 2021

(54) AUDIO SIGNAL PROCESSING APPARATUS AND AUDIO SIGNAL PROCESSING METHOD

(71) Applicant: Mitsubishi Electric Corporation, Tokyo (JP)

(72) Inventors: Kosuke Hosoya, Tokyo (JP); Masaru Kimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/966,980

(22) PCT Filed: Feb. 9, 2018

(86) PCT No.: PCT/JP2018/004585
§ 371 (c)(1),
(2) Date: Aug. 3, 2020

(87) PCT Pub. No.: WO2019/155603
PCT Pub. Date: Aug. 15, 2019

(65) Prior Publication Data
US 2021/0044912 A1 Feb. 11, 2021

(51) Int. Cl.
*H04S 7/00* (2006.01)
*G10L 25/06* (2013.01)
(Continued)

(52) U.S. Cl.
CPC ..... *H04S 7/30* (2013.01); *G10L 25/06* (2013.01); *H04R 3/04* (2013.01); *H04S 1/007* (2013.01); *H04S 2400/13* (2013.01)

(58) Field of Classification Search
None
See application file for complete search history.

(56) References Cited

U.S. PATENT DOCUMENTS 5,970,153 A * 10/1999 Petroff ..... H04R 5/04 381/17
7,162,045 B1 1/2007 Fujii
2014/0056429 A1* 2/2014 Allen ..... H04S 1/002 381/17

FOREIGN PATENT DOCUMENTS

JP 2001-69597 A 3/2001
JP 2005-86462 A 3/2005
(Continued)

OTHER PUBLICATIONS

Japanese Decision of Refusal for Japanese Application No. 2019-570239, dated Dec. 3, 2020, with an English translation.
(Continued)

*Primary Examiner* — Paul W Huber
(74) *Attorney, Agent, or Firm* — Birch, Stewart, Kolasch & Birch, LLP

(57) ABSTRACT

An audio signal processing apparatus includes; a first correlation component separating unit configured to predict a first signal from a second signal in a predetermined period to generate a first correlation component signal and to separate the first non-correlation component signal from the first signal by using the first correlation component signal; a second correlation component separating unit configured to predict a second signal from the first signal in the predetermined period to generate a second correlation component signal and to separate the second non-correlation component signal from the second signal by using the second correlation component signal; a correlation component synthesizing unit configured to synthesize the first correlation component signal and the second correlation component signal to generate a synthesized correlation component signal; a first gain multiplying unit configured to multiply the synthesized correlation component signal by a gain to generate a correlation component signal; a first signal adding unit configured to add a correlation component signal and a first non-correlation component signal; and a second signal add-
(Continued)

ing unit configured to add the correlation component signal and the second non-correlation component signal.

7 Claims, 7 Drawing Sheets

(51) Int. Cl.
*H04R 3/04* (2006.01)
*H04S 1/00* (2006.01)

(56) References Cited

FOREIGN PATENT DOCUMENTS

| | | | |
|---|---|---|---|
| JP | 2008-219246 | A | 9/2008 |
| JP | 5316560 | B2 | 10/2013 |

OTHER PUBLICATIONS

Chinese Office Action and Search Report for Chinese Application No. 201880087908.7, dated Jan. 19, 2021, with an English translation.
Haykin et al., "Adaptive Filter Theory" Kegaku Gijutsu Shuppari, Inc., 2001, Chapter 9, pp. 414-421 (6 pages total), with an English translation.
Japanese Office Action dated Jul. 14, 2020 for Application No. 2019-570239 with an English translation.
Sayed, "Adaptive Filters", LMS Algorithm, IEEE, 2008, pp. 162-177 (10 pages total).
German Office Action, dated Mar. 1, 2001, for German Application No. 112018006786.8, with an English translation.

* cited by examiner

AUDIO SIGNAL PROCESSING APPARATUS AND AUDIO SIGNAL PROCESSING METHOD

TECHNICAL FIELD

The present invention relates to an audio signal processing apparatus and an audio signal processing method.

BACKGROUND ART

In content broadcast on television, human voices such as lines or narration often have a high correlation between left and right channels of a stereo signal. In contrast, background sounds such as BGM often have a low correlation between left and right channels of a stereo signal.

Based on the above premise, there is a technique for improving the ease of hearing human voices by extracting and enhancing the correlation components of the left and right channels of a stereo signal.

For example, Patent Reference 1 discloses a method for enhancing only human voices by applying, to a sum signal of left and right channels of a stereo signal, a filter for extracting a vocal voice band and a notch filter for damping a predetermined frequency component from the vocal voice band.

PRIOR ART REFERENCE

Patent Reference

Patent Reference 1: Japanese Patent Application Publication No. 2005-086462

SUMMARY OF THE INVENTION

Problem to be Solved by the Invention

However, in the prior art, since the correlation component is extracted by using the sum signal of a stereo signal, when there is a deviation of several milliseconds (ms) between the left and right channels of the stereo signal, for example, it is not possible to improve the ease of hearing human voices or the like.

It is therefore an object of one or more aspects of the present invention to improve the ease of hearing human voices even when there is a time axis deviation between the first signal and the second signal.

Means of Solving the Problem

One aspect of the present invention provides an audio signal processing apparatus receiving inputs of a first signal and a second signal, comprising: a first correlation component separating unit configured to predict the first signal from the second signal in a predetermined period to generate a first correlation component signal having a correlation with the first signal in the second signal, and to add a signal having an inverted phase of the first correlation component signal to the first signal to separate, from the first signal, a first non-correlation component signal having no correlation with the second signal; a second correlation component separating unit configured to predict the second signal from the first signal in the predetermined period to generate a second correlation component signal having a correlation with the second signal in the first signal, and to add a signal having an inverted phase of the second correlation component signal to the second signal to separate, from the second signal, a second non-correlation component signal having no correlation with the first signal; a correlation component synthesizing unit configured to synthesize the first correlation component signal and the second correlation component signal to generate a synthesized correlation component signal; a first gain multiplying unit configured to multiply the synthesized correlation component signal by a gain to generate a correlation component signal; a first signal adding unit configured to add the correlation component signal and the first non-correlation component signal; and a second signal adding unit configured to add the correlation component signal and the second non-correlation component signal.

Another aspect of the present invention provides an audio signal processing method comprises: receiving inputs of a first signal and a second signal, predicting the first signal from the second signal in a predetermined period to generate a first correlation component signal having a correlation with the first signal in the second signal; adding a signal having an inverted phase of the first correlation component signal to the first signal to separate, from the first signal, a first non-correlation component signal having no correlation with the second signal; predicting the second signal from the first signal in the predetermined period to generate a second correlation component signal having a correlation with the second signal in the first signal; adding a signal having an inverted phase of the second correlation component signal to the second signal to separate, from the second signal, a second non-correlation component signal having no correlation with the first signal; synthesizing the first correlation component signal and the second correlation component signal to generate a synthesized correlation component signal; multiplying the synthesized correlation component signal by a gain to generate a correlation component signal; adding the correlation component signal and the first non-correlation component signal; and adding the correlation component signal and the second non-correlation component signal.

Effects of the Invention

According to one or more aspects of the present invention, it is possible to improve the ease of hearing human voices even when there is a time axis deviation between the first signal and the second signal.

MODE FOR CARRYING OUT THE INVENTION

Embodiment 1

Figure 1:
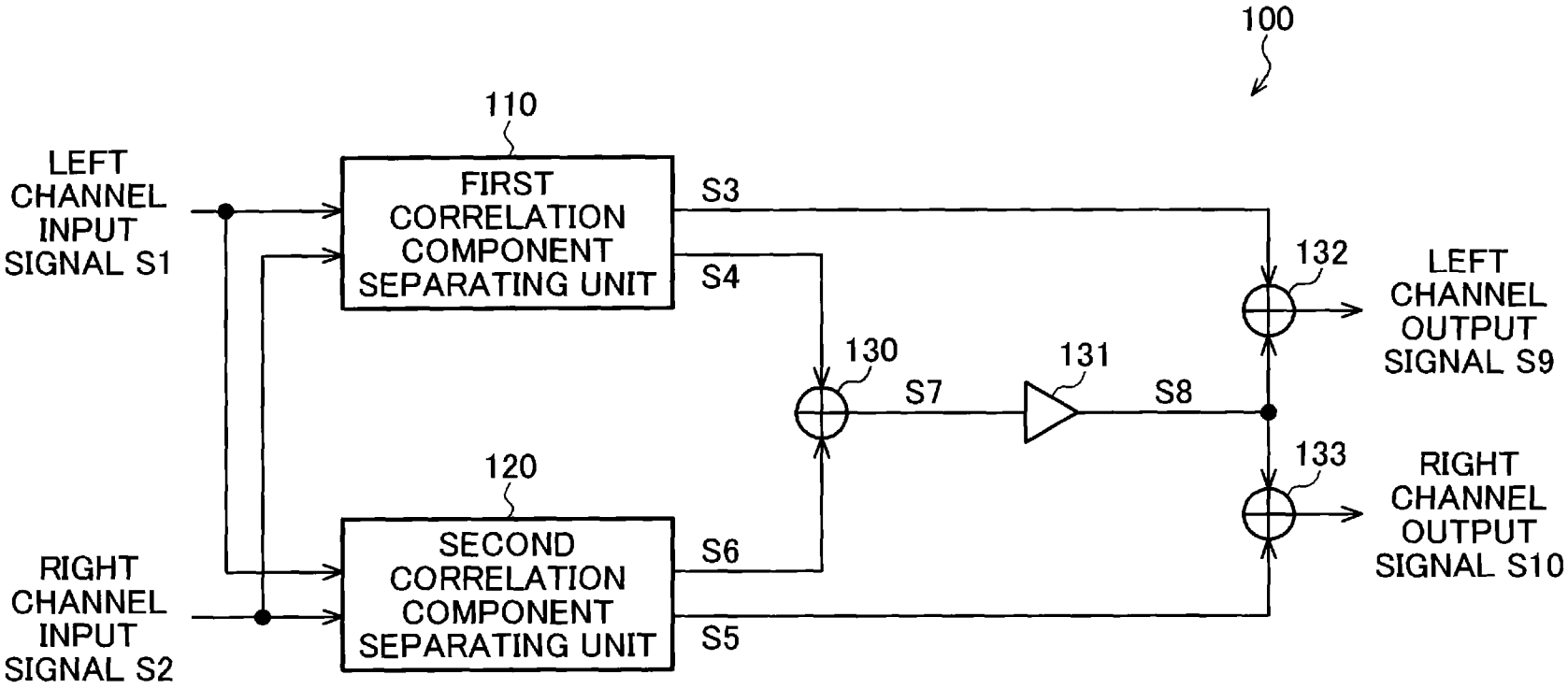
FIG. 1 is a block diagram schematically illustrating a configuration of an audio signal processing apparatus according to Embodiment 1.

FIG. 1 is a block diagram schematically illustrating a configuration of an audio signal processing apparatus 100 according to Embodiment 1.

The audio signal processing apparatus 100 includes a first correlation component separating unit 110, a second correlation component separating unit 120, a correlation component synthesizing unit 130, a gain multiplying unit 131 as a first gain multiplying unit, a first signal adding unit 132, and a second signal adding unit 133.

Herein, it is assumed that the audio signal processing apparatus 100 receives a stereo signal.

The first correlation component separating unit 110 receives inputs of a left channel input signal S1 as a first signal and a right channel input signal S2 as a second signal.

From the right channel input signal S2 in a predetermined period, the first correlation component separating unit 110 generates a first correlation component signal S4 having a correlation with the left channel input signal S1 in the right channel input signal S2.

Further, the first correlation component separating unit 110 adds a signal of an inverted phase of the first correlation component signal S4 to the left channel input signal S1 to separate, from the left channel input signal S1, the left channel non-correlation component signal S3 as the first non-correlation component signal having no correlation with the right channel input signal S2.

Figure 2:
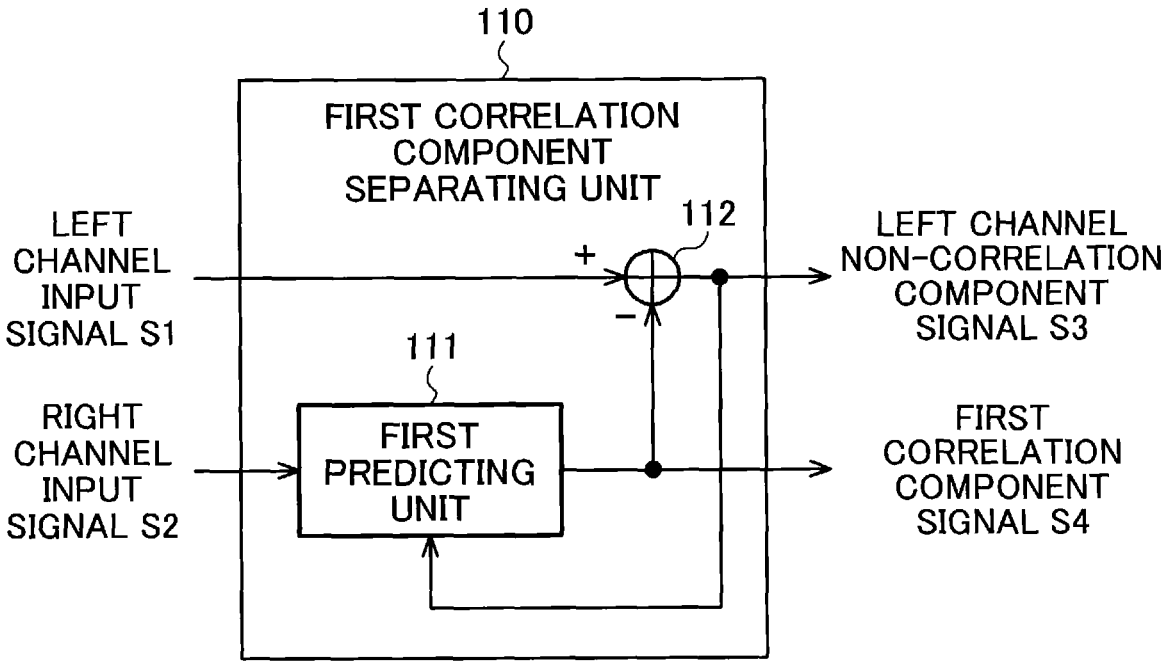
FIG. 2 is a block diagram schematically illustrating a configuration of a first correlation component separating unit.

FIG. 2 is a block diagram schematically illustrating a configuration of the first correlation component separating unit 110.

The first correlation component separating unit 110 includes a first predicting unit 111 and a first non-correlation component calculating unit 112.

In the following description, the current time is referred to as time n, the time a predetermined period before time n is referred to as time n−1, the time the predetermined period before time n−1 is referred to as time n−2, . . . , and the time the predetermined period before time n−(N−1) is referred to as time n−N. Then, the right channel input signal S2 at each of time n, time n−1, time n−2, . . . , and time n-N is represented as r(n), r(n−1), r(n−2), . . . , and r(n−N). It should be noted that N is a prediction order and is an integer of 2 or more.

The first predicting unit 111 predicts the left channel input signal S1 based on r(n), r(n−2), . . . , r(n−N) and a prediction coefficient, treats the predicted signal as a correlation component, and supplies the correlation component as the first correlation component signal S4 to the first non-correlation component calculating unit 112 and the correlation component synthesizing unit 130 shown in FIG. 1. For example, the first correlation component signal S4 is calculated by convolving r(n), r(n−2), . . . , r(n−N) and the prediction coefficient.

As the algorithm used for the prediction, for example, an LMS (Least-Mean-Square) algorithm which is a known adaptive filter technology may be used. That is, the first predicting unit 111 predicts the left channel input signal S1 by the adaptive filter process.

When the adaptive filter technology such as the LMS algorithm is applied to the first predicting unit 111, the first predicting unit 111 updates the value of the prediction coefficient upon receiving the left channel non-correlation component signal S3. This is because the left channel non-correlation component signal S3 is an error signal indicating a prediction error in the adaptive filter technology. Therefore, the first predicting unit 111 predicts the left channel input signal S1 by updating the value of the prediction coefficient so that the error signal approaches zero to, thereby generating the first correlation component signal S4 including a human voice having a high correlation with the left channel input signal S1 in the right channel input signal S2.

Returning to FIG. 1, the second correlation component separating unit 120 receives inputs of the right channel input signal S2 and the left channel input signal S1.

From the left channel input signal S1 in a predetermined period, the second correlation component separating unit 120 generates a second correlation component signal S6 having a correlation with the right channel input signal S2 in the left channel input signal S1.

Further, the second correlation component separating unit 120 adds a signal of an inverted phase of the second correlation component signal S6 to the right channel input signal S2 to separate, from the right channel input signal S2, the right channel non-correlation component signal S5 as the second non-correlation component signal having no correlation with the left channel input signal S1.

Figure 3:
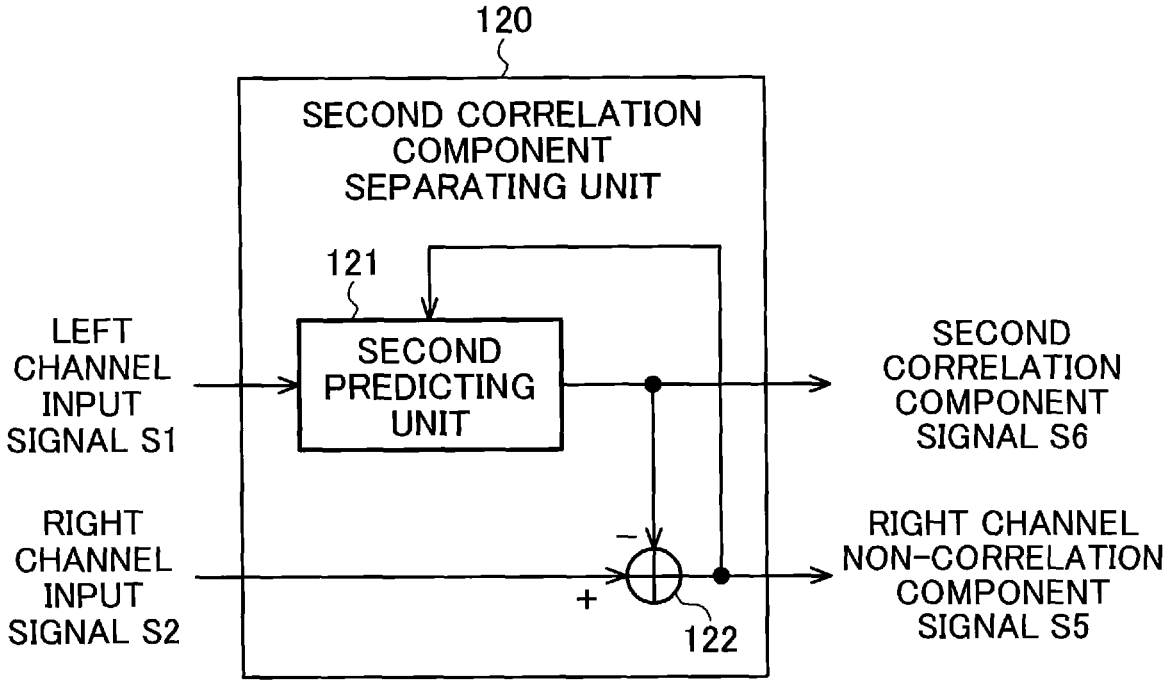
FIG. 3 is a block diagram schematically illustrating a configuration of a second correlation component separating unit.

FIG. 3 is a block diagram schematically illustrating a configuration of the second correlation component separating unit 120.

The second correlation component separating unit 120 includes a second predicting unit 121 and a second non-correlation component calculating unit 122.

In the following description, the left channel input signal S1 at each of time n, time n−1, time n−2, . . . , and time n−N is represented by 1(n), 1(n−1), 1(n−2), . . . , 1(n−N).

The second predicting unit 121 predicts the right channel input signal S2 based on 1(n), 1(n−1), 1(n−2), . . . , 1(n−N) and a prediction coefficient, treats the predicted signal as a correlation component, and supplies the correlation component as the second correlation component signal S6 to the second non-correlation component calculating unit 122 and the correlation component synthesizing unit 130 shown in FIG. 1. For example, the second correlation component signal S6 is calculated by convolving 1(n), 1(n−1), 1(n−2), . . . , 1(n−N) and the prediction coefficient.

As the algorithm used for prediction, the LMS algorithm or the like may be used in the same manner as in the first predicting unit 111.

When an adaptive filter technology such as the LMS algorithm is applied to the second predicting unit 121, the second predicting unit 121 updates the value of the prediction coefficient upon receiving the right channel non-correlation component signal S5 described later. This is because the right channel non-correlation component signal S5 is an error signal indicating a prediction error in the adaptive filter technology. Therefore, the second predicting unit 121 predicts the right channel input signal S2 by updating the value of the prediction coefficient so that the error signal approaches zero, thereby generating the second correlation component signal S6 including a human voice having a high correlation with the right channel input signal S2 in the left channel input signal S1.

The second non-correlation component calculating unit 122 inverts the phase of the second correlation component signal S6 supplied from the second predicting unit 121 and adds the phase-inverted second correlation component signal S6 and the right channel input signal S2 to calculate the right channel non-correlation component signal S5. As described above, the right channel non-correlation component signal S5 is an error signal in the adaptive filter technology.

Returning to FIG. 1, the correlation component synthesizing unit 130 receives the first correlation component signal S4 and the second correlation component signal S6, and adds these two signals to synthesize them, thereby calculating a synthesized correlation component signal S7.

For example, the correlation component synthesizing unit 130 performs a process based on the following Equation (1) and supplies the calculated $X_P$ (n) to the gain multiplying unit 131 as a synthesized correlation component signal S7.

Equation (1)

$$x_p(n)=(l_p(n)+r_p(n))/2 \quad (1)$$

In the above equation, $l_P$ (n) represents the first correlation component signal S4, and $r_P$ (n) represents the second correlation component signal S6.

The gain multiplying unit 131 receives the synthesized correlation component signal S7, multiply the synthesized correlation component signal S7 by a gain, and supplies the synthesized correlation component signal multiplied by the gain to a first signal adding unit 132 and a second signal adding unit 133 as a correlation component signal S8.

Here, since the synthesized correlation component signal S7 contains many components of human voices, the gain for the multiplication is preferably larger than 1. In addition, the value of the gain may be a fixed value or a variable value set by a user using a GUI (Graphical User Interface) via an input unit and a display unit not shown.

A first signal adding unit 132 adds the left channel non-correlation component signal S3 and the correlation component signal S8 to generate a left channel output signal S9 as a final output. The left channel output signal S9 thus generated is output to a subsequent stage of the audio signal processing apparatus 100.

Similarly, the second signal adding unit 133 adds the right channel non-correlation component signal S5 and the correlation component signal S8 to generate a right channel output signal S10 as a final output. The right channel output signal S10 thus generated is output to a subsequent stage of the audio signal processing apparatus 100.

The audio signal processing apparatus 100 can be implemented by hardware (H/W) or software (S/W).

Figure 4A:
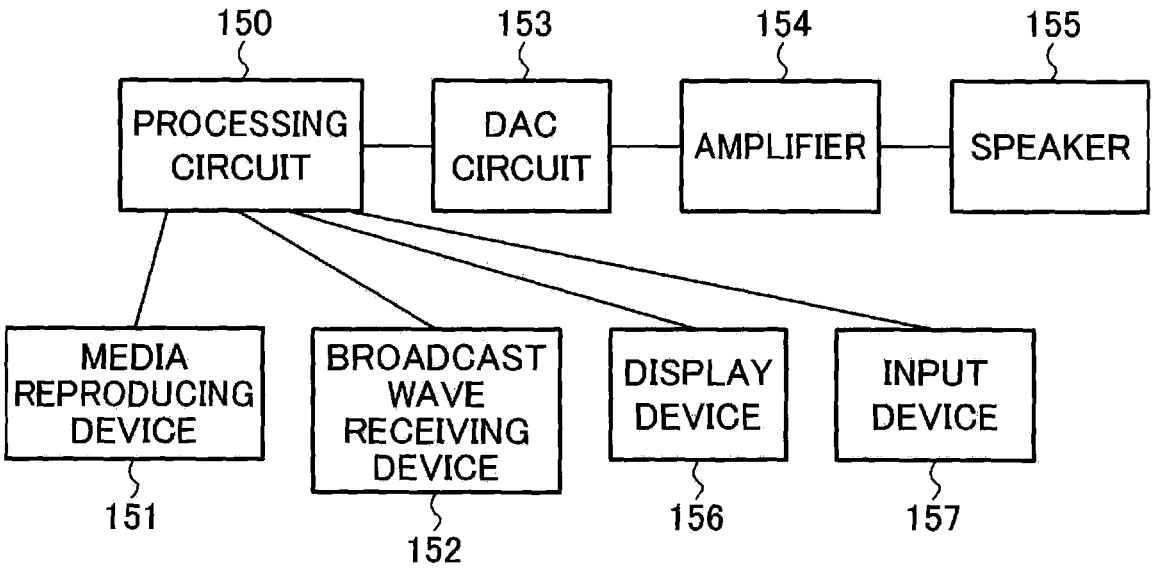
FIGS. 4A and 4B are block diagrams illustrating examples of hardware and software configurations of an audio signal processing apparatus.

FIG. 4A is a block diagram illustrating an example in which the audio signal processing apparatus 100 is implemented by H/W.

The audio signal processing apparatus 100 can be implemented by a processing circuit 150. In this case, the processing circuit 150 receives a stereo signal from a media reproducing device 151 or a broadcast wave receiving device 152. The stereo signal processed by the processing circuit 150 is converted into an analog signal by a DAC circuit 153 and passed to a speaker 155 via an amplifier 154. It should be noted that the media reproducing device 151 is a device for reading digital information from a medium such as a CD (Compact Disc), a DVD (Digital Versatile Disc), or a BD (Blu-ray Disc).

Further, a display device 156 functions as a display unit for displaying a screen image for changing the gain value, and an input device 157 functions as an input unit for inputting the gain value.

Figure 4B:
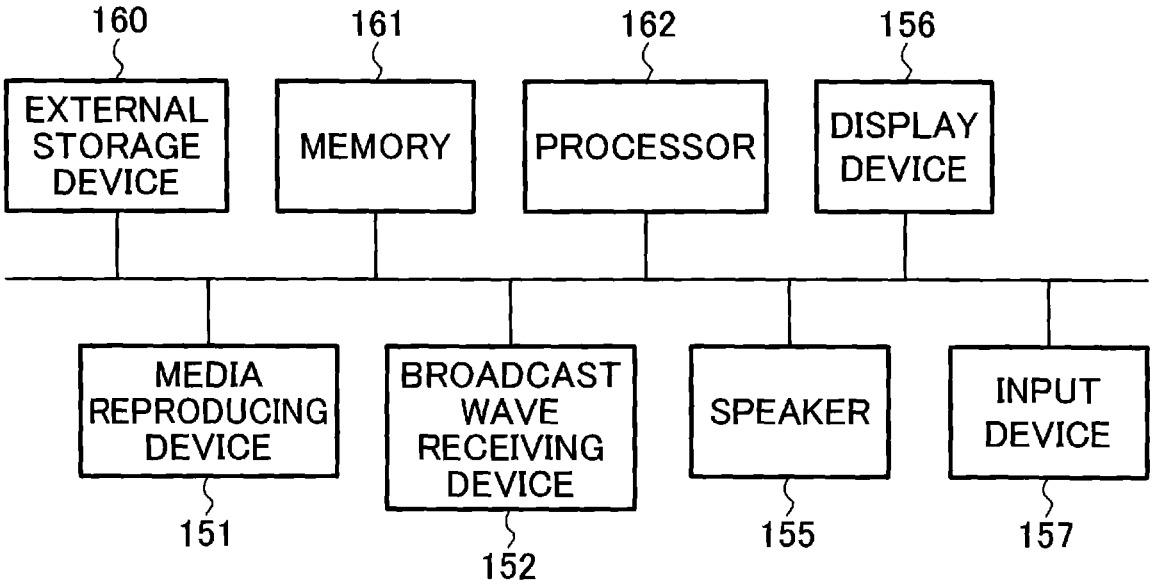

FIG. 4B is a block diagram illustrating an example in which the audio signal processing apparatus 100 is implemented by S/W.

The audio signal processing apparatus 100 can be implemented by reading a program stored in an external storage device 160 into a memory 161 and executing the program by a processor 162. In this case, the processor 162 processes the data stored in the external storage device 160 or the data expanded in the memory 161. The external storage device 160 is, for example, a storage device such as a hard disk drive (HDD) or a solid state drive (SSD) connected directly or via a network.

It should be noted that the media reproducing device 151, the broadcast wave receiving device 152, the speaker 155, the display device 156, or the input device 157 may be connected.

The processing circuit 150, the media reproducing device 151, or the broadcast wave receiving device 152, the DAC circuit 153, the amplifier 154, the speaker 155, the display device 156, and the input device 157 shown in FIG. 4A may constitute an audio device 100.

Alternatively, the external storage device 160, the memory 161, the processor 162, the media reproducing device 151 or the broadcast wave receiving device 152, the speaker 155, the display device 156, and the input device 157 shown in FIG. 4B may constitute an audio device 100.

Figure 5:
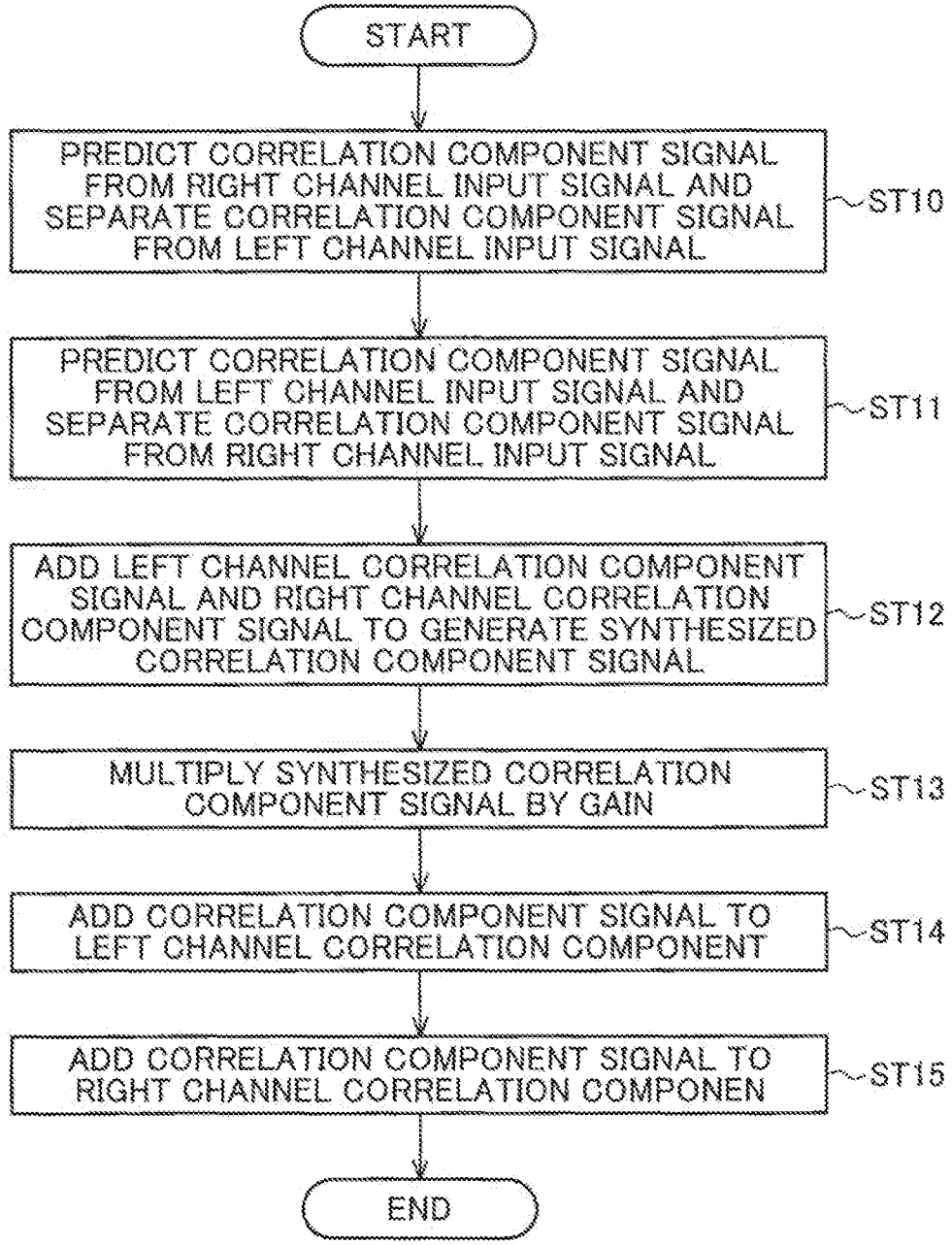
FIG. 5 is a flowchart indicating a process in an audio signal processing apparatus.

FIG. 5 is a flowchart indicating a process in the audio signal processing apparatus 100 in Embodiment 1.

First, the first correlation component separating unit 110 receives the inputs of a left channel input signal S1 and a right channel input signal S2, and generates a left channel non-correlation component signal S3 and a first correlation component signal S4 (ST10).

Further, the second correlation component separating unit 120 receives the inputs of the right channel input signal S2 and the left channel input signal S1 and generates a right channel non-correlation component signal S5 and a second correlation component signal S6 (ST11).

Next, the correlation component synthesizing unit 130 synthesizes the first correlation component signal S4 and the second correlation component signal S6 to generate a synthesized correlation component signal S7 (ST12).

Next, the gain multiplying unit 131 multiplies the synthesized correlation component signal S7 by a gain to generate a correlation component signal S8 (ST13).

Next, the first signal adding unit 132 adds the left channel non-correlation component signal S3 and the correlation component signal S8 to generate a left channel output signal S9 (ST14).

The second signal adding unit 133 adds the right channel non-correlation component signal S5 and the correlation component signal S8 to generate a right channel output signal S10 (ST15).

As described above, according to Embodiment 1, it is possible to improve the ease of hearing human voices by separating the input signal into the correlation component signal and the non-correlation component signal by using the correlation component separating units 110, 120 and by multiplying the correlation component signal by a gain.

Further, since the algorithm of the adaptive filter is used to extract the correlation component, it is possible to extract the correlation component shifted by several milliseconds in the left and right channels of stereo signals.

Embodiment 2

Figure 6:
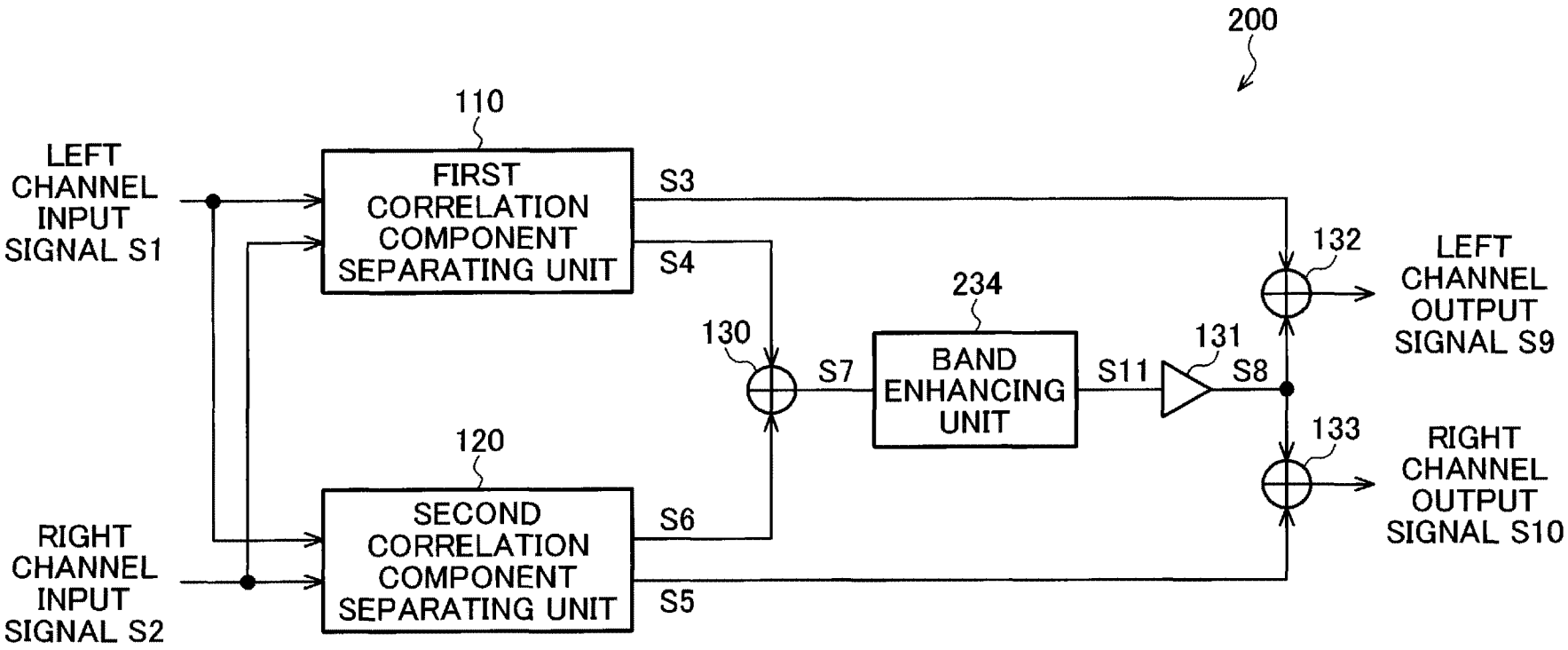
FIG. 6 is a block diagram schematically illustrating a configuration of an audio signal processing apparatus according to Embodiment 2.

FIG. 6 is a block diagram schematically illustrating a configuration of an audio signal processing apparatus 200 according to Embodiment 2.

The audio signal processing apparatus 200 includes a first correlation component separating unit 110, a second correlation component separating unit 120, a correlation component synthesizing unit 130, a gain multiplying unit 131, a first signal adding unit 132, a second signal adding unit 133, and a band enhancing unit 234.

The audio signal processing apparatus 200 according to Embodiment 2 is configured in the same manner as the audio signal processing apparatus 100 according to Embodiment 1 except that the band enhancing unit 234 is added.

It should be noted that the correlation component synthesizing unit 130 supplies the synthesized correlation component signal S7 to the band enhancing unit 234, and the gain multiplying unit 131 multiplies the enhanced synthesized correlation component signal S11 supplied from the band enhancing unit 234 by a gain, as will be described later.

Figure 7:
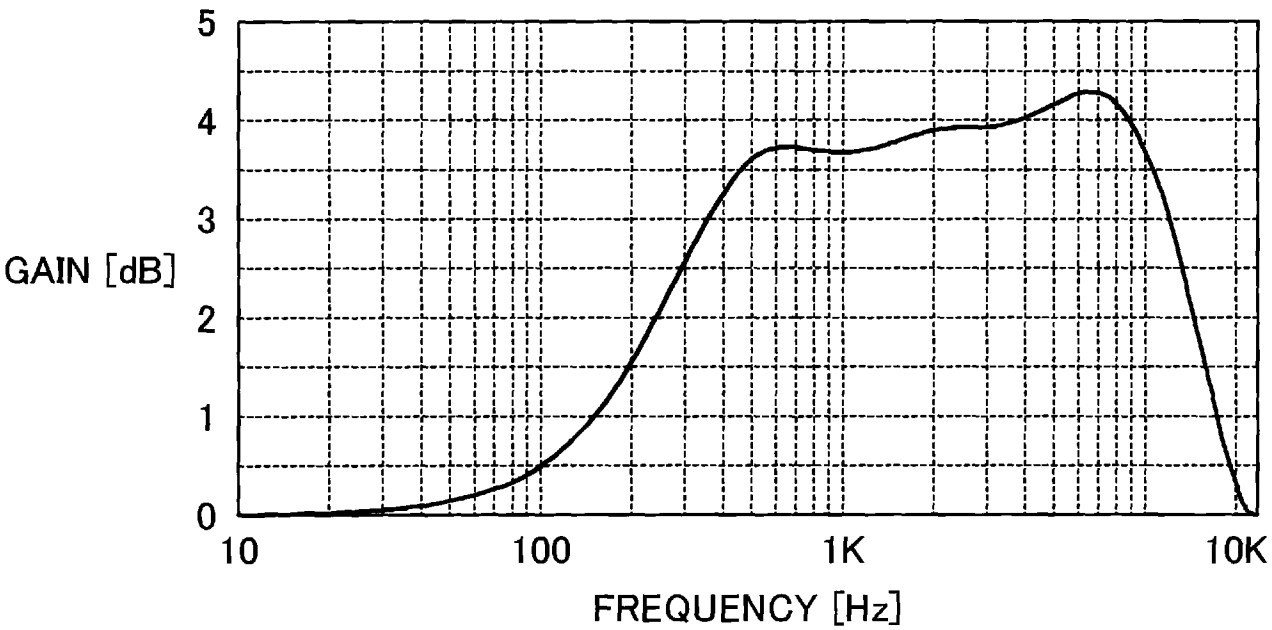
FIG. 7 is a schematic diagram illustrating an example of frequency characteristics of a digital filter used for band enhancement.

The band enhancing unit 234 receives the synthesized correlation component signal S7 and enhances a band that is easy for a person to hear in the synthesized correlation component signal S7 by filter processing. The digital filter used by the band enhancing unit 234 may be implemented by a FIR (Finite Impulse Response) filter or an IIR (Infinite Impulse Response) filter. FIG. 7 shows an example of frequency characteristics of a digital filter used for band enhancement.

The band that is easy for a person to hear is a band important for the ease of hearing a person's voice.

The band enhancing unit 234 provides the band-enhanced and synthesized correlation component signal to the gain multiplying unit 131 as an enhanced synthesized correlation component signal S11.

As described above, according to Embodiment 2, since the band enhancing unit 234 enhances the band which is important for the ease of hearing human voices, the clearness of the human voice is further improved.

Embodiment 3

Figure 8:
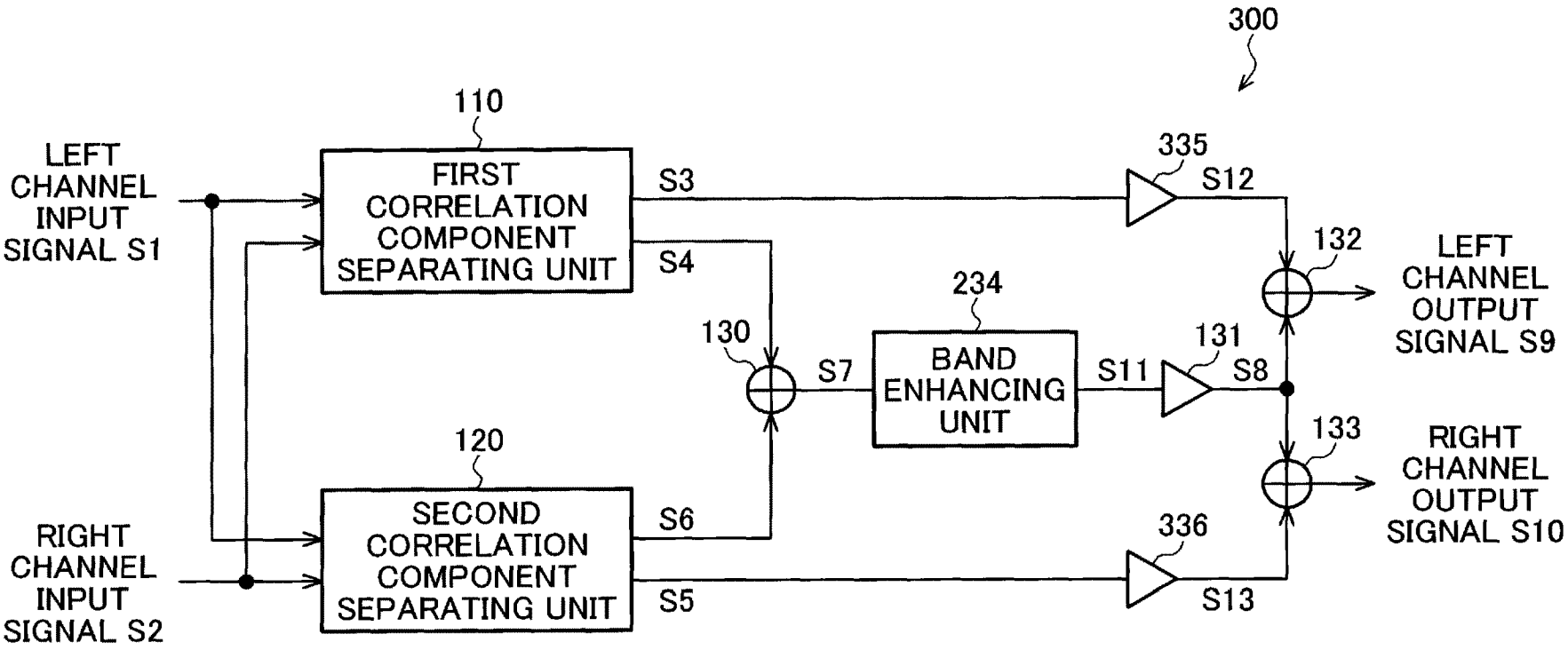
FIG. 8 is a block diagram schematically illustrating a configuration of an audio signal processing apparatus according to Embodiment 3.

FIG. 8 is a block diagram schematically illustrating a configuration of an audio signal processing apparatus 300 according to Embodiment 3.

The audio signal processing apparatus 300 includes a first correlation component separating unit 110, a second correlation component separating unit 120, a correlation component synthesizing unit 130, a gain multiplying unit 131, a first signal adding unit 132, a second signal adding unit 133, a band enhancing unit 234, a gain multiplying unit 335 as a second gain multiplying unit, and a gain multiplying unit 336 as a third gain multiplying unit.

The audio signal processing apparatus 300 according to Embodiment 3 is configured in the same manner as the audio signal processing apparatus 200 according to Embodiment 2, except that the gain multiplying unit 335 and the gain multiplying unit 336 are added.

It should be noted that the first correlation component separating unit 110 supplies the separated left channel non-correlation component signal S3 to the gain multiplying unit 335, and the second correlation component separating unit 120 supplies the separated right channel non-correlation component signal S5 to the gain multiplying unit 336.

In addition, the first signal adding unit 132 adds the multiplied left channel non-correlation component signal S12 supplied from the gain multiplying unit 335 and the correlation component signal S8, and the second signal adding unit 133 adds the multiplied right channel non-correlation component signal S13 supplied from the gain multiplying unit 336 and the correlation component signal S8.

The gain multiplying unit 335 receives the left channel non-correlation component signal S3, multiplies the left channel non-correlation component signal S3 by a gain, and supplies the gain-multiplied left channel non-correlation component signal to the first signal adding unit 132 as the multiplied left channel non-correlation component signal S12. Here, since the left channel non-correlation component signal S3 mainly contains components other than the human voice, the gain for the multiplication is desirably smaller than 1. Also, the gain value may be a fixed value or a variable value set by a user using a GUI as described above.

The gain multiplying unit 336 receives the right channel non-correlation component signal S5, multiplies the right channel non-correlation component signal S5 by a gain, and supplies the gain-multiplied right channel non-correlation component signal to the second signal adding unit 133 as the multiplied right channel non-correlation component signal S13. Here, since the right channel non-correlation component signal S5 mainly contains components other than the human voice, the gain of multiplication is desirably smaller than 1. Also, the gain value may be a fixed value or a variable value set by a user using a GUI as described above.

As described above, according to Embodiment 3, since the gain multiplying units 335, 336 can reduce the volume of components other than the human voice, the clearness of the human voice is further improved.

In Embodiment 3, the band enhancing unit 234 may not be provided.

DESCRIPTION OF REFERENCE CHARACTERS

100, 200, 300 audio signal processing apparatus, 110 first correlation component separating unit, 111 first predicting unit, 112 first non-correlation component calculating unit, 120 second correlation component separating unit, 121 second predicting unit, 122 second non-correlation component calculating unit, 130 correlation component synthesizing unit, 131 gain multiplying unit, 132 first signal adding unit, 133 second signal adding unit, 234 band enhancing unit, 335 gain multiplying unit, 336 gain multiplying unit

What is claimed is:

1. An audio signal processing apparatus receiving inputs of a first signal and a second signal, comprising:

processing circuitry to predict the first signal from the second signal in a predetermined period to generate a first correlation component signal having a correlation with the first signal in the second signal;

to add a signal having an inverted phase of the first correlation component signal to the first signal to separate, from the first signal, a first non-correlation component signal having no correlation with the second signal;

to predict the second signal from the first signal in the predetermined period to generate a second correlation component signal having a correlation with the second signal in the first signal;

to add a signal having an inverted phase of the second correlation component signal to the second signal to separate, from the second signal, a second non-correlation component signal having no correlation with the first signal;

to synthesize the first correlation component signal and the second correlation component signal to generate a synthesized correlation component signal;

to multiply the synthesized correlation component signal by a first gain to generate a correlation component signal;

to add the correlation component signal and the first non-correlation component signal; and to add the correlation component signal and the second non-correlation component signal.

2. The audio signal processing apparatus according to claim 1, wherein the processing circuitry applies a digital filter to the synthesized correlation component signal to enhance a band that is easy for a person to hear; and wherein the processing circuitry multiplies the synthesized correlation component signal enhanced by the processing circuitry by the first gain.

3. The audio signal processing apparatus according to claim 1, wherein a second gain multiplying unit configured to the processing circuitry multiplies the first non-correlation component signal by a second gain;

wherein the processing circuitry multiplies the second non-correlation component signal by a third gain, wherein the processing circuitry adds the correlation component signal and the first non-correlation component signal processed by the processing circuitry; and wherein the processing circuitry adds the correlation component signal and the second non-correlation component signal processed by the processing circuitry.

4. The audio signal processing apparatus according to claim 3, wherein a value of at least one of the first gain, the second gain, and the third gain is changeable.

5. The audio signal processing apparatus according to claim 2, wherein the processing circuitry multiplies the first non-correlation component signal by a third gain;

wherein the processing circuitry multiplies the second non-correlation component signal by a third gain, wherein the processing circuitry adds the correlation component signal and the first non-correlation component signal processed by the processing circuitry; and wherein the processing circuitry adds the correlation component signal and the second non-correlation component signal processed by the processing circuitry.

6. The audio signal processing apparatus according to claim 5, wherein a value of at least one of the first gain, the second gain, and the third gain is changeable.

7. An audio signal processing method comprises:

receiving inputs of a first signal and a second signal, predicting the first signal from the second signal in a predetermined period to generate a first correlation component signal having a correlation with the first signal in the second signal;

adding a signal having an inverted phase of the first correlation component signal to the first signal to separate, from the first signal, a first non-correlation component signal having no correlation with the second signal;

predicting the second signal from the first signal in the predetermined period to generate a second correlation component signal having a correlation with the second signal in the first signal;

adding a signal having an inverted phase of the second correlation component signal to the second signal to separate, from the second signal, a second non-correlation component signal having no correlation with the first signal;

synthesizing the first correlation component signal and the second correlation component signal to generate a synthesized correlation component signal;

multiplying the synthesized correlation component signal by a gain to generate a correlation component signal;

adding the correlation component signal and the first non-correlation component signal; and adding the correlation component signal and the second non-correlation component signal.

* * * * *